US010114334B2

(12) United States Patent
Ohhira et al.

(10) Patent No.: US 10,114,334 B2
(45) Date of Patent: Oct. 30, 2018

(54) DEVELOPING DEVICE WITH CASING HAVING UPPER AND LOWER COMPARTMENTS

(71) Applicants: Tatsuya Ohhira, Kanagawa (JP); Masayuki Yamane, Kanagawa (JP); Keiichi Yoshida, Kanagawa (JP); Atsushi Kurokawa, Kanagawa (JP); Toshiki Hayashi, Kanagawa (JP); Yuuki Tsuchiya, Tokyo (JP)

(72) Inventors: Tatsuya Ohhira, Kanagawa (JP); Masayuki Yamane, Kanagawa (JP); Keiichi Yoshida, Kanagawa (JP); Atsushi Kurokawa, Kanagawa (JP); Toshiki Hayashi, Kanagawa (JP); Yuuki Tsuchiya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/467,582

(22) Filed: Mar. 23, 2017

(65) Prior Publication Data

US 2017/0293257 A1 Oct. 12, 2017

(30) Foreign Application Priority Data

Apr. 12, 2016 (JP) ..... 2016-079706

(51) Int. Cl.
*G03G 15/08* (2006.01)
*G03G 21/18* (2006.01)

(52) U.S. Cl.
CPC ..... *G03G 21/1814* (2013.01); *G03G 15/0889* (2013.01); *G03G 15/0891* (2013.01)

(58) Field of Classification Search
CPC ..... G03G 21/1814
(Continued)

(56) References Cited

U.S. PATENT DOCUMENTS

2011/0008075 A1 1/2011 Taguchi et al.
2011/0311279 A1* 12/2011 Okazaki ..... G03G 15/0893 399/254

(Continued)

FOREIGN PATENT DOCUMENTS

| | | |
|---|---|---|
| JP | 2008-039986 | 2/2008 |
| JP | 2008-256917 | 10/2008 |
| JP | 2011-248127 | 12/2011 |

OTHER PUBLICATIONS

U.S. Appl. No. 15/288,939, filed Oct. 7, 2016.

*Primary Examiner* — Quana M Grainger
(74) *Attorney, Agent, or Firm* — Oblon, McClelland, Maier & Neustadt, L.L.P.

(57) ABSTRACT

A developing device includes a developer bearer, a casing defining an upper compartment to contain the developer and a lower compartment disposed lower than the upper compartment, to contain the developer, and a first conveyor and a second conveyor disposed in the upper compartment and the lower compartment, respectively, to convey the developer in a longitudinal direction of the developer bearer and circulate the developer between the upper compartment and the lower compartment through a first communicating opening, through which the developer is conveyed upward, and a second communicating opening. A developer-lifting range of the upper compartment, which opposes the first communicating opening, is larger in volume than a developer-lifting range of the lower compartment. One of the upper compartment and the lower compartment is disposed adjacent to the developer bearer to supply the developer to the developer bearer.

8 Claims, 3 Drawing Sheets

(58) Field of Classification Search
USPC ..... 399/111, 254, 256
See application file for complete search history.

(56) References Cited

U.S. PATENT DOCUMENTS

| | | | | |
|---|---|---|---|---|
| 2012/0213554 | A1* | 8/2012 | Hayashi | G03G 15/0893 399/254 |
| 2012/0321352 | A1* | 12/2012 | Iida | G03G 15/0893 399/254 |
| 2016/0378021 | A1 | 12/2016 | Yamane et al. | |

* cited by examiner

DEVELOPING DEVICE WITH CASING HAVING UPPER AND LOWER COMPARTMENTS

CROSS-REFERENCE TO RELATED APPLICATIONS

This patent application is based on and claims priority pursuant to 35 U.S.C. § 119(*a*) to Japanese Patent Application No. 2016-079706, filed on Apr. 12, 2016, in the Japan Patent Office, the entire disclosure of which is hereby incorporated by reference herein.

BACKGROUND

Technical Field

Embodiments of the present invention generally relate to a developing device, a process cartridge, and an image forming apparatus, such as a copier, a printer, a facsimile machine, or a multifunction peripheral (MFP) having at least two of copying, printing, facsimile transmission, plotting, and scanning capabilities.

Description of the Related Art

There are developing devices that include a developing roller, a developer container to contain developer supplied to the developing roller, and at least two developer conveyors (e.g., conveying screws) disposed in the developer container. The developer conveyors circulate the developer inside the developer container, and developer is supplied to the developing device from outside according to the consumption of developer.

SUMMARY

An embodiment of the present invention provides a developing device that includes a developer bearer to bear developer, a casing defining an upper compartment to contain the developer and a lower compartment disposed lower than the upper compartment to contain the developer, and a first conveyor and a second conveyor disposed in the upper compartment and the lower compartment, respectively, to convey the developer in a longitudinal direction of the developer bearer. The upper compartment and the lower compartment communicate with each other through a first communicating opening, through which the developer is conveyed upward, and a second communicating opening. Each of the upper compartment and the lower compartment includes a developer-lifting range opposing the first communicating opening. One of the upper compartment and the lower compartment is disposed adjacent to the developer bearer to supply the developer to the developer bearer. The first conveyor and the second conveyor are to circulate the developer between the upper compartment and the lower compartment through the first communicating opening and the second communicating opening. The developer-lifting range of the upper compartment is larger in volume than the developer-lifting range of the lower compartment.

In another embodiment, a process cartridge includes a latent image bearer to bear a latent image, and the above-described developing device to develop the latent image with the developer.

In yet another embodiment, an image forming apparatus includes a latent image bearer to bear a latent image, and the above-described developing device to develop the latent image with the developer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
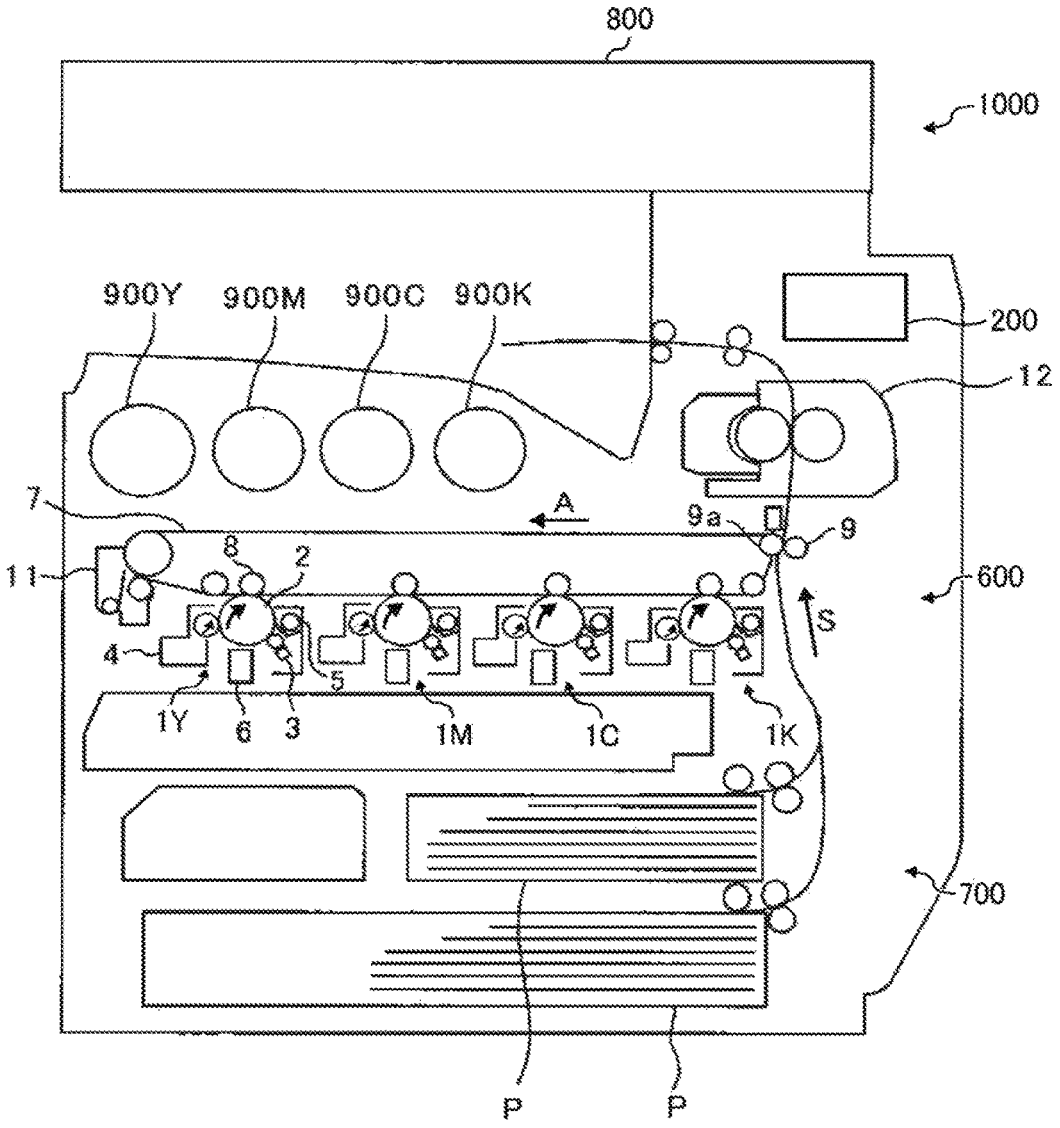
FIG. 1 is a schematic diagram of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

FIG. 1 is a schematic view of a configuration of an image forming apparatus 1000 according to the present embodiment.

As illustrated in FIG. 1, the image forming apparatus 1000 includes a body, which is hereinafter referred to as "printer body 600", a sheet feeding table, which is hereinafter referred to as "sheet feeder 700", and a scanner 800 mounted on the printer body 600.

The printer body 600 includes four process cartridges 1 (1Y, 1M, 1C, and 1K), an intermediate transfer belt 7, and a fixing device 12. The intermediate transfer belt 7 serves as an intermediate transfer member and rotates in the direction indicated by arrow A in FIG. 1 (hereinafter "belt travel direction"), entrained around multiple tension rollers. The intermediate transfer member is not limited to a belt but can be a drum or film.

It is to be noted that the suffixes Y, M, C, and K attached to each reference numeral indicate only that components indicated thereby are used for forming yellow, magenta, cyan, and black images, respectively, and may be omitted when color discrimination is not necessary. The four process cartridges 1 have a similar configuration except the color of toner used therein, and hereinafter the suffixes Y, M, C, and K may be omitted when color discrimination is not necessary.

Each process cartridge 1 includes a photoconductor 2, a charger 3, a developing device 4, and a photoconductor cleaning device 5, which are hold in a common unit casing. The process cartridge 1 can be installed in the image forming apparatus 1000 and removed therefrom by releasing a stopper.

The photoconductor 2 rotates clockwise in the drawing as indicated by arrow illustrated in FIG. 1. The charger 3 can be a charging roller. The charger 3 is pressed against a surface of the photoconductor 2 to rotate as the photoconductor 2 rotates. During image formation, a high-voltage power source applies a predetermined bias to the charger 3 to electrically charge the surface of the photoconductor 2. Although the process cartridge 1 according to the present embodiment includes the charger 3 that contacts the surface of the photoconductor 2, alternatively, a contactless charger such as a corona charger may be used instead.

An exposure device 6 exposes the surface of the photoconductor 2 according to image data read by the scanner 800 or acquired by an external device such as a computer, thereby forming an electrostatic latent image thereon. In the present embodiment, a light-emitting diode (LED) array is used as the exposure device 6. The LED array extends throughout the image formation area of the photoconductor 2 in the longitudinal direction of the photoconductor 2.

The photoconductor cleaning device 5 removes residual toner remaining on the photoconductor 2 downstream from the position opposing the intermediate transfer belt 7 in the direction of rotation of the photoconductor 2.

The four process cartridges 1 form yellow, cyan, magenta, and black toner images on the photoconductors 2, respectively. As illustrated in FIG. 1, the four process cartridges 1 are arranged in parallel to the belt travel direction indicated by arrow A. The toner images formed on the respective photoconductors 2 are transferred therefrom and superimposed sequentially one on another on the intermediate transfer belt 7 (primary transfer process). Thus, a multicolor visible image is formed on the intermediate transfer belt 7.

In FIG. 1, primary transfer rollers 8 serving as primary transfer members are disposed at positions facing the respective photoconductors 2 via the intermediate transfer belt 7. Receiving a primary transfer bias from a high-voltage power source, the primary transfer roller 8 generates a primary-transfer electrical field between the photoconductor 2 and the primary transfer roller 8. With the primary-transfer electrical field, the toner images are transferred from the photoconductors 2, respectively, onto the intermediate transfer belt 7. As one of the multiple tension rollers, around which the intermediate transfer belt 7 is entrained, is rotated by a driving motor, the intermediate transfer belt 7 rotates in the belt travel direction indicated by arrow A illustrated in FIG. 1. The toner images are sequentially transferred onto the rotating intermediate transfer belt 7 and superimposed one on another thereon, forming a multicolor toner image.

Downstream from the four process cartridges 1 in the belt travel direction indicated by arrow A, a secondary transfer roller 9 is disposed. The secondary transfer roller 9 is opposite, across the intermediate transfer belt 7, from a tension roller 9*a*, which is one of the multiple tension rollers. The secondary transfer roller 9 and the tension roller 9*a* together form a secondary transfer nip. The tension roller 9*a* is also referred to as a secondary-transfer backup roller. A predetermined voltage is applied to the secondary transfer roller 9 or the tension roller 9*a* (secondary-transfer backup roller) to generate a secondary-transfer electrical field therebetween. Transfer sheets P (i.e., recording media) fed from the sheet feeder 700 are transported in the direction indicated by arrow S illustrated in FIG. 1 (hereinafter "sheet conveyance direction") and pass through the secondary transfer nip. When the transfer sheet P passes through the secondary transfer nip, the multicolor toner image is transferred from the intermediate transfer belt 7 onto the transfer sheet P by the effects of the secondary-transfer electrical field (secondary transfer process).

The fixing device 12 is disposed downstream from the secondary transfer nip in the sheet conveyance direction. Exiting the secondary transfer nip, the transfer sheet P reaches the fixing device 12. The fixing device 12 fixes, with heat and pressure, the multicolor toner image on the transfer sheet P that has passed through the secondary transfer nip, after which the transfer sheet P is discharged outside the image forming apparatus 1000.

Meanwhile, a belt cleaning unit 11 removes toner remaining on the intermediate transfer belt 7 after the secondary transfer process.

As illustrated in FIG. 1, toner bottles 900 (900Y, 900M, 900C, and 900K) containing respective color toners are removably disposed above the intermediate transfer belt 7.

A toner supply device supplies the toner from the toner bottle 900 to the developing device 4 of the corresponding color. The image forming apparatus 1000 includes a controller 200 to control the operation of the image forming apparatus 100. The controller 200 is not necessarily mounted in the image forming apparatus 1000 but can be remote.

The process cartridge 1 and the developing device 4 are described in further detail below.

Figure 2:
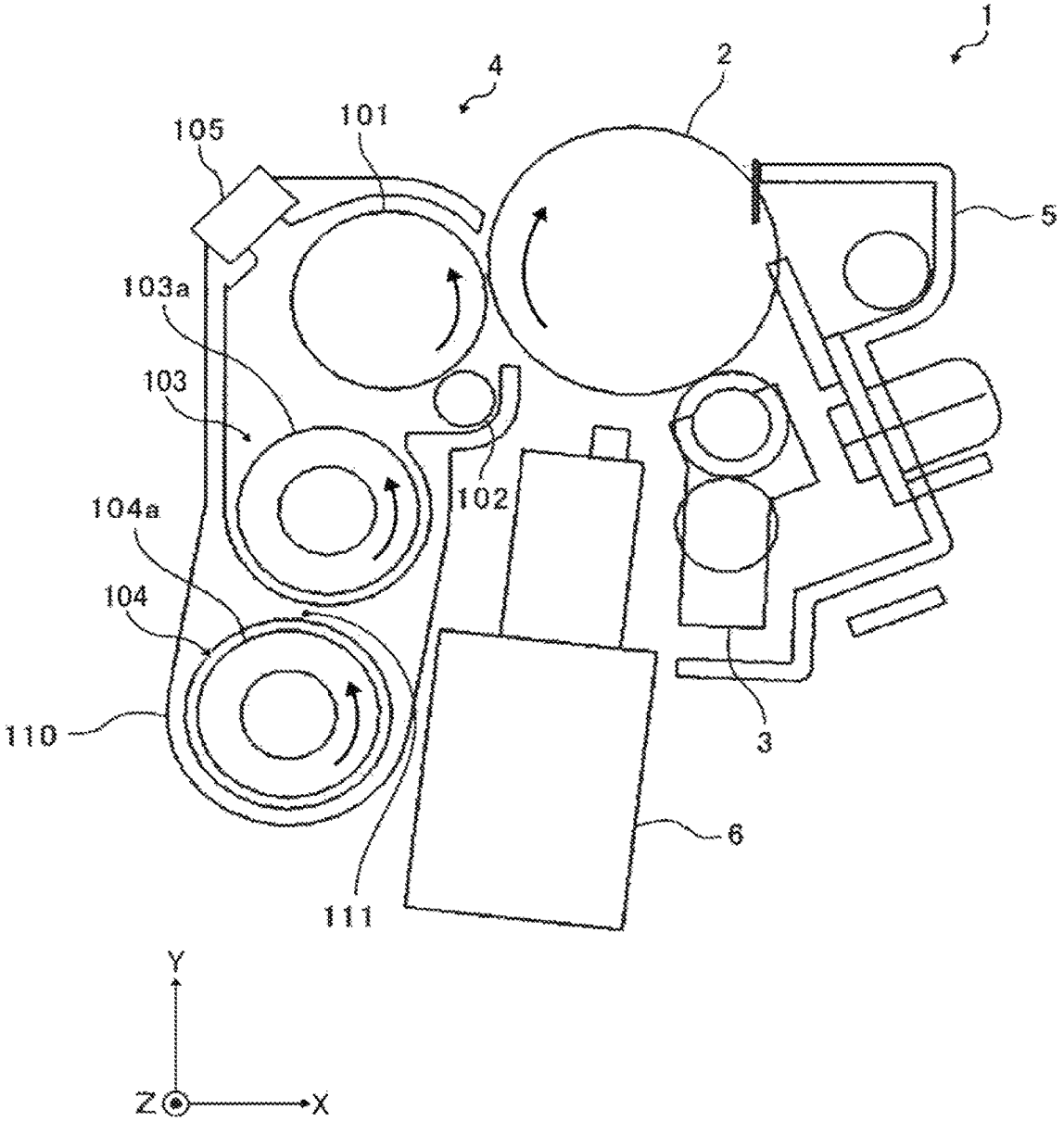
FIG. 2 is a schematic cross-sectional view of a process cartridge installable in the image forming apparatus illustrated in FIG. 1.

FIG. 2 is a schematic end-on axial view illustrating a configuration of the process cartridge 1.

As illustrated in FIG. 2, the process cartridge 1 according to the present embodiment includes the photoconductor 2, the charger 3, the developing device 4, the photoconductor cleaning device 5, and the exposure device 6. The photoconductor 2, the charger 3, and the photoconductor cleaning device 5 are united into a photoconductor unit.

The developing device 4 includes, as a developer bearer, a developing roller 101. The developing roller 101 includes a cylindrical developing sleeve that rotates in the direction indicated in FIG. 2 and a magnet roller that does not rotate, disposed inside the developing sleeve. In the present embodiment, the developing roller 101 has a diameter of 16 mm, for example.

Disposed on the lower right of the developing roller 101 in FIG. 2 is a developer regulator 102 to regulate the amount of developer borne on the developing roller 101. In the present embodiment, the developer regulator 102 is a metal rod having a diameter of 5 mm, for example.

A casing 110 serves as a developer container to contain developer and defines a supply compartment 103 (i.e., an upper compartment) and a stirring compartment 104 (i.e., a lower compartment), both of which are located below or lower than the developing roller 101. The developer contained in the supply compartment 103 is supplied to the developing roller 101 while being conveyed therein. The developer in the stirring compartment 104 is stirred with supplied toner while being conveyed therein. The casing 110 includes a partition 111 to partition the supply compartment 103 and the stirring compartment 104 from each other. At both end of the partition 111 in the longitudinal direction of the developing device 4, communicating openings 106 (illustrated in FIG. 3) between the supply compartment 103 and the stirring compartment 104 are provided.

The type of developer circulation in the developing device 4 according to the present embodiment is biaxial circulation. Since two developer containing compartments are disposed one above the other, this circulation type is called vertical biaxial circulation. The developing device 4 includes two developer conveyors to rotate to convey the developer while stirring the developer inside the developer container. Specifically, a supply screw 103*a* (i.e., a first conveyor) is disposed in the supply compartment 103, and a stirring screw 104*a* (i.e., a second conveyor) is disposed in the stirring compartment 104. The supply screw 103*a* includes a rotation shaft 103*a*1 and a spiral blade 103*a*2 projecting from the rotation shaft 103*a*1. Similarly, the stirring screw 104*a* includes a rotation shaft 104*a*1 and a spiral blade 104*a*2 projecting from the rotation shaft 104*a*1. The developer conveyors are not limited to screws but can be augers, coils, paddles, and the like.

The developer transported by the supply screw 103*a* to a periphery of the developing roller 101 is attracted onto the surface of the developing roller 101 due to the magnetic force exerted by the developing roller 101. The developer regulator 102 regulates the amount of the developer borne on the developing roller 101. Subsequently, the developer is transported to the developing range opposing the photoconductor 2 and used to develop an electrostatic latent image on the photoconductor 2. Downstream from the developing range in the direction of rotation of the developing roller 101, the developing roller 101 conveys the developer into the developing device 4. Then, due to a repulsive magnetic force of the developing roller 101, the developer leaves the developing roller 101 and returns into the supply compartment 103.

In the developing device 4, a magnetic brush of developer on the surface of the developing roller 101 returning into the developing device 4 generates, between the casing 110 and the developing roller 101, airflow trending from outside into the developing device 4. The airflow prevents the scattering of toner that is not used in image developing.

The casing 110 has a vent communicating with outside and disposed downstream from the developing range where the developing roller 101 opposes the photoconductor 2 in the direction of rotation of the developing roller 101. A filter 105 is disposed at the vent to block the developer. The air inside the casing 110 can be discharged through the vent to inhibit increases in the pressure inside the developing device 4 due to the airflow trending into the developing device 4.

Figure 3:
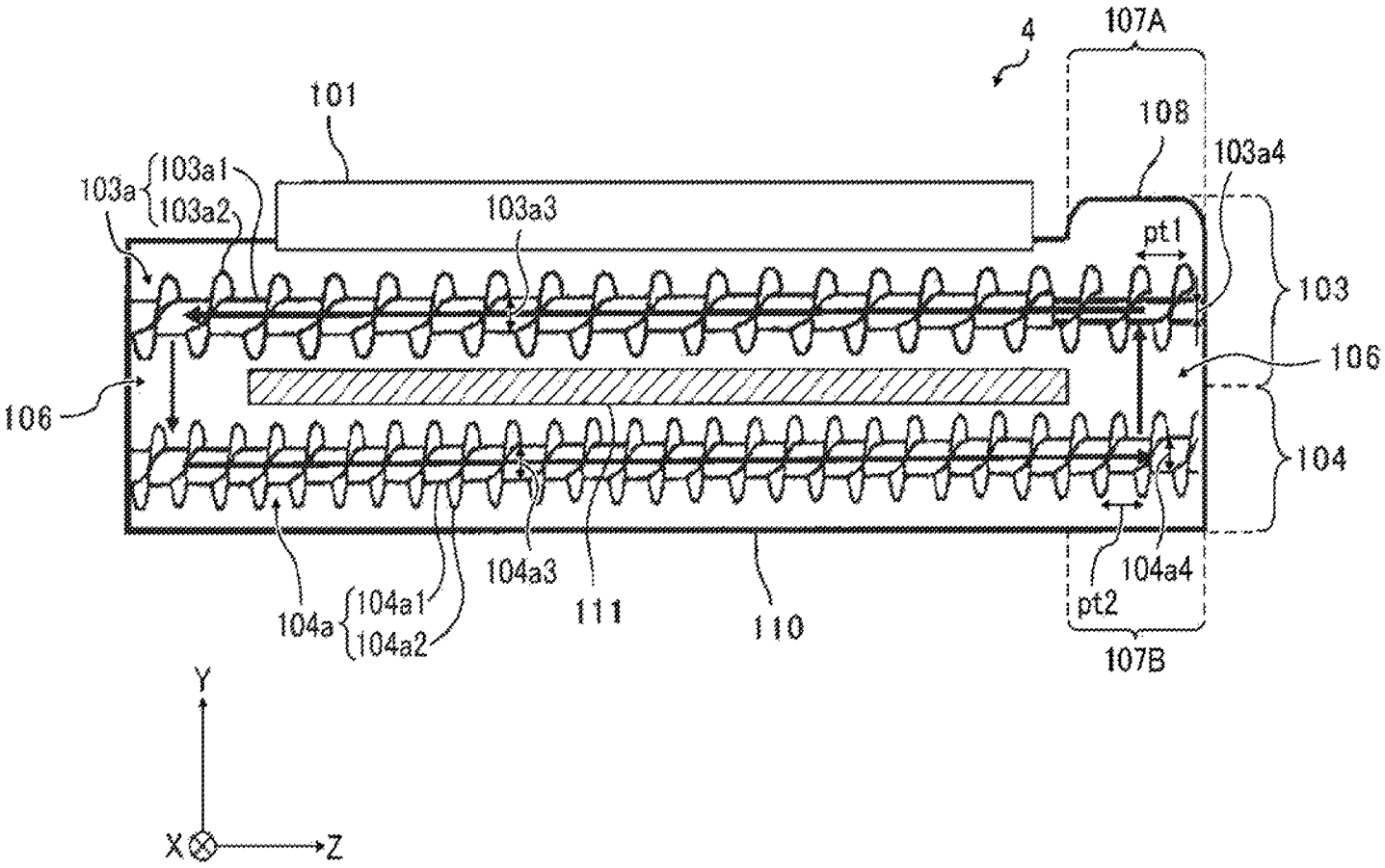
FIG. 3 is a cross-sectional view of a developing device included in the process cartridge illustrated in FIG. 2, as viewed in a direction perpendicular to the cross section illustrated in FIG. 2.

FIG. 3 is a cross-sectional view of the developing device 4 as viewed on the cross section perpendicular to the x axis illustrated in FIG. 2.

As illustrated in FIG. 3, the supply compartment 103 and the stirring compartment 104 communicate with each other through the communicating openings 106 at both ends in the axial direction of the developing device 4. For example, each communicating opening 106 is rectangular and 25 mm in the longitudinal direction of the developing device 4 (lateral direction in FIG. 3) and 10 mm in the width direction of the developing device 4 (lateral direction in FIG. 2). In the developing device 4, the two developer conveyors, namely, the supply screw 103 a and the stirring screw 104*a*, convey the developer in the directions indicated by respective arrows in FIG. 3, thereby circulating the developer between the supply compartment 103 and the stirring compartment 104. As described above, the developer that has been used in image developing on the developing roller 101 is returned into the supply compartment 103 by the repulsive magnetic force. The developer is then conveyed through the communicating opening 106 to the stirring compartment 104, stirred with the toner supplied from a toner supply inlet, and again conveyed to the supply compartment 103. With this operation, the concentration of toner in the developer supplied to the developing roller 101 is kept in a desirable range.

Descriptions are given below of developer conveyance in developing devices employing vertical biaxial circulation, in particular, in a range above and below the communicating opening 106 (on the right in FIG. 3) through which the developer is conveyed up from the stirring compartment 104 to the supply compartment 103. The range above the communicating opening 106 is hereinafter referred to as a developer-lifting range 107A, and the range below the communicating opening 106 is hereinafter referred to as a developer-lifting range 107B.

To convey the developer from the stirring compartment 104 toward the supply compartment 103, the stirring screw 104*a* applies pressure to the developer inside the stirring compartment 104, thereby conveying the developer against the gravity. Accordingly, the developer is likely to accumulate in the developer-lifting range 107B (i.e., stirring-compartment side) below the communicating opening 106.

Additionally, in developing devices employing vertical biaxial circulation, if a large amount of developer is supplied to the supply compartment to supply a sufficient amount of developer to the developing roller, a communicating portion on the upper side (supply-compartment side in FIG. 3), that is, an area above the communicating opening inside the casing, is likely to be filled to capacity with the developer. If the interior of the casing above the communicating opening is filled with developer, pressure arises in the developer above the communicating opening, receiving pressure from the casing. When the developer is lifted from the stirring compartment to the supply compartment, lifting of developer from below the communicating opening may be inhibited by the pressure of the developer above the communicating opening. There is a risk of accumulation of developer adjacent to the communicating opening.

If the developer accumulates adjacent to the communicating opening, the amount of developer supplied to the supply compartment may become insufficient. In such a case, mixing of the developer returned from the developing roller to the supply compartment with the developer therein becomes insufficient, or the bulk or height of developer inside the supply compartment decreases. Then, the amount of developer supplied to the developing roller is insufficient, the amount of developer borne on the developing roller decreases, and image failure is caused.

In view of the foregoing, in the developing device 4 according to the present embodiment, as illustrated in FIG. 3, the volume of the developer-lifting range 107A in the supply compartment 103 is made larger than the developer-lifting range 107B in the stirring compartment 104. In other words, in the range opposing the communicating opening 106 (through which developer is lifted, on the right in FIG. 3) in the longitudinal direction of the developing roller 101, the volume of the supply compartment is made larger than the volume of the stirring compartment 104. With this structure, the pressure applied from the casing 110 to the developer contained in the developer-lifting range 107A of the supply compartment 103 above the communicating opening 106 can be smaller than the pressure applied from the casing 110 to the developer contained in the developer-lifting range 107B of the stirring compartment 104 below the communicating opening 106.

This structure attains the following advantage compared with a configuration in which the volume of the portion of the supply compartment 103 above the communicating opening 106 is equal to or smaller than the volume of the portion of the stirring compartment 104 below the communicating opening 106. This structure can reduce the adverse effect on the developer below the communicating opening 106, given by the developer above the communicating opening 106. Accordingly, the developer can move easily from the stirring compartment 104 to the supply compartment 103, and the developer is inhibited from accumulating adjacent to the communicating opening 106. Thus, the amount of developer supplied to the developing roller 101 can be sufficient.

In the developing device 4 according to the present embodiment, the casing 110 includes a bulge 108 located above the developer-lifting range 107A and projecting upward. With the bulge 108, the volume of the developer-lifting range 107A in the supply compartment 103 is made greater than the volume of the developer-lifting range 107B in the stirring compartment 104. In another embodiment, the bulge 108 projects to a lateral side in FIG. 3 or in a direction perpendicular to the surface of the paper on which FIG. 3 is drawn.

The casing 110 shaped as described above can release, to the space defined by the bulge 108, the pressure applied from the casing 110 to the developer in the developer-lifting range 107A in the supply compartment 103. Accordingly, this structure can alleviate the effect of the pressure on the developer in the developer-lifting range 107B of the stirring compartment 104, applied from the developer in the developer-lifting range 107A of the supply compartment 103. Then, conveyance of developer from the stirring compartment 104 to the supply compartment 103 is facilitated, and accumulation of developer in the developer-lifting ranges 107A and 107B is inhibited.

Additionally, in the developing device 4 according to the present embodiment, the supply screw 103*a* and the stirring screw 104*a* have the following structures.

For example, the outer diameter of the supply screw 103*a* is 12 mm. A portion of the supply screw 103*a* disposed in the developer-lifting range 107A has a second shaft diameter 103*a*4 of 6 mm, and the remaining portion (outside the developer-lifting range 107A) of the supply screw 103*a* has a first shaft diameter 103*a*3 of 8 mm. The spiral blade 103*a*2 is triple-threaded and has a lead length of 45 mm and a pitch (a distance between adjacent screw threads) of 15 mm.

For example, the outer diameter of the stirring screw 104*a* is 12 mm. A portion of the stirring screw 104*a* disposed in the developer-lifting range 107B has a second shaft diameter 104*a*4 of 8 mm, and the remaining portion (outside the developer-lifting range 107B) of the stirring screw 104*a* has a first shaft diameter 104*a*3 of 6 mm. The spiral blade 104*a*2 is double-threaded and has a lead length of 25 mm and a pitch of 12.5 mm.

Thus, the second shaft diameter 103*a*4 (e.g., 6 mm) of the supply screw 103*a* in the developer-lifting range 107A is made smaller than the second shaft diameter 104*a*4 (e.g., 8 mm) of the stirring screw 104*a* in the developer-lifting range 107B to make the volume of the developer-lifting range 107A (on the supply-compartment side) larger than the volume of the developer-lifting range 107B (on the stirring-compartment side).

Additionally, in the developing device 4 according to the present embodiment, a pitch pt1 of the supply screw 103*a* in the developer-lifting range 107A is greater than a pitch pt2 of the stirring screw 104*a* in the developer-lifting range 107B. With this structure, the volume of the developer-lifting range 107A (on the supply-compartment side) is made larger than the volume of the developer-lifting range 107B (on the stirring-compartment side).

Further, in the developing device 4 according to the present embodiment, the shaft diameters of the developer conveyors are in the following relation. The second shaft diameter 104*a*4 of the stirring screw 104*a* in the developer-lifting range 107B is equal to or smaller than the first shaft diameter 103*a*3 of the supply screw 103*a* in the range outside the developer-lifting range 107A and greater than the second shaft diameter 103*a*4 of the supply screw 103*a* in the developer-lifting range 107A.

When the second shaft diameter 104*a*4 of the stirring screw 104*a* in the developer-lifting range 107B is greater than the second shaft diameter 103*a*4 of the supply screw 103*a* in the developer-lifting range 107A, the volume of the developer-lifting range 107A (on the supply-compartment side) can be larger than the volume of the developer-lifting range 107B (on the stirring-compartment side). Thus, accumulation of developer in the developer-lifting range 107B can be inhibited.

The second shaft diameter 104*a*4 of the stirring screw 104*a* in the developer-lifting range 107B is equal to or smaller than the first shaft diameter 103*a*3 of the supply screw 103*a* outside the developer-lifting range 107A and greater than the second shaft diameter 103*a*4 of the supply screw 103*a* in the developer-lifting range 107A. With this structure, the bulk of developer required in the supply compartment 103 can be attained with a smaller amount of developer. Accordingly, the cost of developer can be reduced, and the developing device can be compact.

Additionally, in the developing device 4 according to the present embodiment, the rotation speed (for example, 550 revolutions per minute or rpm) of the stirring screw 104*a* is faster than the rotation speed (for example, 460 rpm) of the supply screw 103*a*. When the rotation speed of the stirring screw 104*a* is faster than the rotation speed of the supply screw 103*a*, the capability to convey the developer in the stirring compartment 104 is greater than the capability to convey the developer in the supply compartment 103. With this configuration, the developer can be conveyed from the stirring compartment 104 to the supply compartment 103 more efficiently.

To rotate the supply screw 103*a* and the stirring screw 104*a*, for example, the developing device 4 is provided with one motor and gear trains to transmit the rotation from the motor to the supply screw 103*a* and the stirring screw 104*a*, respectively. The gear trains make the rotation speed transmitted to the stirring screw 104*a* different from the rotation speed transmitted to the supply screw 103*a*. Alternatively, the developing device 4 is provided with two motors to drive the supply screw 103*a* and the stirring screw 104*a* at speeds different from each other.

Although the description above concerns the developing device in which the stirring compartment is disposed lower than the supply compartment, one or more aspects of this disclosure are applicable to other configurations. For example, one or more aspects of the present disclosure are applicable to an arrangement in which the supply compartment is disposed lower than the stirring compartment.

The structures described above are just examples, and the various aspects of the present specification attain respective effects as follows.

Aspect A

A developing device (e.g., the developing device 4) includes a developer bearer (e.g., the developing roller 101) to bear developer; an upper compartment (e.g., the supply compartment 103) to contain the developer supplied to the developer bearer; a lower compartment (e.g., the stirring compartment 104) disposed lower than the upper compartment; and a first conveyor and a second conveyor (e.g., the supply screw 103*a* and the stirring screw 104*a*) respectively disposed in the upper compartment and the lower compartment to circulate the developer between the upper compartment and the lower compartment through a first communicating opening and a second communicating opening (e.g., the communicating openings 106). One of the upper compartment and the lower compartment is a supply compartment disposed adjacent to the developer bearer so that the developer is supplied therefrom to the developer bearer while being conveyed therein. The other of the upper compartment and the lower compartment is a stirring compartment in which the developer is stirred with supplied toner while being conveyed therein. The developer is conveyed upward from the lower compartment to the upper compartment through the first communicating opening (i.e., the developer-lifting opening). When a range of each of the upper compartment and the lower compartment opposing the first communicating opening is referred to as a developer-lifting range, the developer-lifting range of the upper compartment has a volume larger than a volume of the developer-lifting range of the lower compartment.

For example, when the upper compartment is the supply compartment and the lower compartment is the stirring compartment, the developer is conveyed such that the amount of developer supplied to the supply compartment is relatively large to supply a sufficient amount of developer to the developer bearer. In the portion around the developer-lifting opening, the interior of the casing above the developer-lifting opening (the supply-compartment side) is likely to be filled to capacity with the developer. If the interior of the casing above the communicating opening is filled to capacity with developer, pressure arises in the developer above the communicating opening, receiving pressure from the casing. When the developer is lifted from the stirring compartment to the supply compartment, lifting of developer from below the communicating opening may be inhibited by the pressure of the developer above the communicating opening. There is a risk of accumulation of developer adjacent to the communicating opening.

The following effect is available according to the aspect that the developer-lifting range of the upper compartment above the first communicating opening is larger in volume than the developer-lifting range of the lower compartment located below the communicating opening. The pressure applied from the casing 110 to the developer contained inside the casing (supply-compartment side) above the communicating opening can be smaller than the pressure applied from the casing to the developer contained in the casing (stirring-compartment side) below the communicating opening. This structure can reduce the effect on the developer (in the lower compartment) located below the communicating opening, given by the developer (in the upper compartment) located above the communicating opening. Accordingly, the developer can move easily from the lower compartment to the upper compartment, and the developer is inhibited from accumulating adjacent to the communicating opening. Accordingly, in the arrangement in which the supply compartment is disposed above or higher than the stirring compartment, the amount of developer supplied to the developer bearer can be sufficient.

Alternatively, in the arrangement in which the stirring compartment is disposed above or higher than the supply compartment, if the developer accumulates adjacent to the communicating opening, the bulk or height of developer in the upper compartment decreases. In such a case, the developer may be stirred insufficiently. According to Aspect A, in such an arrangement, the developer is inhibited from accumulating adjacent to the communicating opening, thereby inhibiting insufficiency of stirring of developer.

Aspect B

In Aspect A, the upper compartment (e.g., the supply compartment 103) is the supply compartment, and the lower compartment (e.g., the stirring compartment 104) is the stirring compartment.

Aspect C

In Aspect A or B, each of the first conveyor (e.g., the supply screw 103*a*) and the second conveyor (e.g., the stirring screw 104*a*) includes a blade (e.g., the spiral blade 103*a*2 and the spiral blade 104*a*2) to rotate to convey the developer.

Aspect D

In Aspect C, the shaft diameter (e.g., 103*a*4) of the first conveyor such as the supply screw 103*a* is smaller than the shaft diameter (1 104*a*4) of the second conveyor such as the stirring screw 104*a*.

According to this aspect, the developer-lifting range of the upper compartment above the first communicating opening can be larger in volume than the developer-lifting range of the lower compartment located below the communicating opening.

Aspect E

In Aspect C or D, the pitch of the first conveyor such as the supply screw 103*a* is larger than the pitch of the second conveyor such as the stirring screw 104*a*.

According to this aspect, the developer-lifting range of the upper compartment above the first communicating opening can be larger in volume than the developer-lifting range of the lower compartment located below the communicating opening.

Aspect F

In any one of Aspect A through E, the rotation speed of the second conveyor such as the stirring screw 104*a* is faster than the rotation speed of the first conveyor such as the supply screw 103*a*.

As described above, when the rotation speed of the second conveyor is faster than the rotation speed of the first conveyor, the capability to convey the developer in the second compartment is greater than the capability to convey the developer in the first compartment. With this configuration, the developer can be lifted from the second compartment to the first compartment more efficiently.

Aspect G

In any one of Aspects C through F, the developer-lifting range (e.g., 107A and 107B) represents the range opposing the first communicating opening in each of the upper compartment and the lower compartment. A shaft diameter (e.g., 104*a*4) of the second conveyor (such as the stirring screw 104*a*) in the developer-lifting range is not smaller than a first shaft diameter (e.g., 103*a*3) of the first conveyor (such as the supply screw 103*a*) outside the developer-lifting range and is larger than a second shaft diameter (e.g., 103*a*4) of the first conveyor in the developer-lifting range.

According to this aspect, the volume in the developer-lifting range of the upper compartment above the first communicating opening can be larger than the volume in the developer-lifting range of the lower compartment below the communicating opening. Thus, accumulation of developer in the developer-lifting range can be inhibited.

Further, when the shaft diameter (e.g., 104*a*4) of the second conveyor in the developer-lifting range is not larger than the shaft diameter (e.g., 103*a*3) of the first conveyor outside the developer-lifting range, the volume of the upper compartment outside the developer-lifting range can be reduced. With this structure, the bulk of developer required in the upper compartment can be attained with a smaller amount of developer. Accordingly, the cost of developer can be reduced, and the developing device can be compact.

Aspect H

In a process cartridge (e.g., the process cartridge 1) that includes at least a latent image bearer such as the photoconductor 2 to bear a latent image and a developing device to develop the latent image with the developer, the developing device according to any one of Aspect A through G is used.

Aspect I

In an image forming apparatus (e.g., the image forming apparatus 1000) that includes a latent image bearer to bear a latent image and a developing device to develop the latent image with the developer, the developing device according to any one of Aspect A through G is used.

According to this aspect, a sufficient amount of developer is supplied to the image bearer, thereby inhibiting image failure resulting from shortage of developer supplied to the image bearer.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device, comprising:

a developer bearer to bear developer;

a casing defining an upper compartment to contain the developer and a lower compartment disposed lower than the upper compartment, to contain the developer, the upper compartment and the lower compartment communicating with each other through a first communicating opening, through which the developer is conveyed upward, and a second communicating opening, the upper compartment and the lower compartment each including a developer-lifting range opposing the first communicating opening, the developer-lifting range of the upper compartment being larger in volume than the developer-lifting range of the lower compartment; and a first conveyor and a second conveyor disposed in the upper compartment and the lower compartment, respectively, to convey the developer in a longitudinal direction of the developer bearer, the first conveyor and the second conveyor to circulate the developer between the upper compartment and the lower compartment through the first communicating opening and the second communicating opening, wherein one of the upper compartment and the lower compartment is a supply compartment disposed adjacent to the developer bearer to supply the developer to the developer bearer, each of the first conveyor and the second conveyor includes a blade to rotate to convey the developer, each of the first conveyor and the second conveyor includes a shaft, and a shaft diameter of the first conveyor is smaller than a shaft diameter of the second conveyor.

2. The developing device according to claim 1, wherein the upper compartment is the supply compartment, and the lower compartment is a stirring compartment in which the developer is stirred while being conveyed in the longitudinal direction of the developer bearer.

3. The developing device according to claim 1, wherein the casing includes a bulge located above the first communicating opening to increase the volume of the developer-lifting range of the upper compartment.

4. A developing device, comprising:

a developer bearer to bear developer;

a casing defining an upper compartment to contain the developer and a lower compartment disposed lower than the upper compartment, to contain the developer, the upper compartment and the lower compartment communicating with each other through a first communicating opening, through which the developer is conveyed upward, and a second communicating opening, the upper compartment and the lower compartment each including a developer-lifting range opposing the first communicating opening, the developer-lifting range of the upper compartment being larger in volume than the developer-lifting range of the lower compartment; and a first conveyor and a second conveyor disposed in the upper compartment and the lower compartment, respectively, to convey the developer in a longitudinal direction of the developer bearer, the first conveyor and the second conveyor to circulate the developer between the upper compartment and the lower compartment through the first communicating opening and the second communicating opening, wherein one of the upper compartment and the lower compartment is a supply compartment disposed adjacent to the developer bearer to supply the developer to the developer bearer, each of the first conveyor and the second conveyor includes a blade to rotate to convey the developer, each of the first conveyor and the second conveyor includes a screw, and a pitch of the first conveyor is larger than a pitch of the second conveyor.

5. The developing device according to claim 1, wherein a rotation speed of the second conveyor is greater than a rotation speed of the first conveyor.

6. A developing device, comprising:

a developer bearer to bear developer;

a casing defining an upper compartment to contain the developer and a lower compartment disposed lower than the upper compartment, to contain the developer, the upper compartment and the lower compartment communicating with each other through a first communicating opening, through which the developer is conveyed upward, and a second communicating opening, the upper compartment and the lower compartment each including a developer-lifting range opposing the first communicating opening, the developer-lifting range of the upper compartment being larger in volume than the developer-lifting range of the lower compartment; and a first conveyor and a second conveyor disposed in the upper compartment and the lower compartment, respectively, to convey the developer in a longitudinal direction of the developer bearer, the first conveyor and the second conveyor to circulate the developer between the upper compartment and the lower compartment through the first communicating opening and the second communicating opening, wherein one of the upper compartment and the lower compartment is a supply compartment disposed adjacent to the developer bearer to supply the developer to the developer bearer, each of the first conveyor and the second conveyor includes a blade to rotate to convey the developer, each of the first conveyor and the second conveyor includes a screw, and a shaft diameter of the second conveyor in the developer-lifting range is not smaller than a first shaft diameter of the first conveyor outside the developer-lifting range and is larger than a second shaft diameter of the first conveyor in the developer-lifting range.

7. A process cartridge, comprising:

a latent image bearer to bear a latent image; and the developing device according to claim 1 to develop the latent image with the developer.

8. An image forming apparatus, comprising:

a latent image bearer to bear a latent image; and the developing device according to claim 1, to develop the latent image with the developer.

* * * * *